United States Patent [19]

Jackson et al.

[11] Patent Number: 5,075,129

[45] Date of Patent: Dec. 24, 1991

[54] METHOD OF PRODUCING TUNGSTEN CHROMIUM CARBIDE-NICKEL COATINGS HAVING PARTICLES CONTAINING THREE TIMES BY WEIGHT MORE CHROMIUM THAN TUNGSTEN

[75] Inventors: John E. Jackson, Brownsburg; Lynn M. McCaslin, Indianapolis; Anthony J. Stavros, Carmel; Robert C. Tucker, Jr., Brownsburg, all of Ind.

[73] Assignee: Union Carbide Coatings Service Technology Corporation, Danbury, Conn.

[21] Appl. No.: 620,538

[22] Filed: Nov. 30, 1990

Related U.S. Application Data

[62] Division of Ser. No. 441,712, Nov. 27, 1989, Pat. No. 4,999,255.

[51] Int. Cl.[5] ..... B05D 1/00

[52] U.S. Cl. ..... 427/34; 427/191; 427/225; 427/423

[58] Field of Search ..... 427/34, 190, 419.7, 427/398.1, 191, 225, 423

[56] References Cited

U.S. PATENT DOCUMENTS

| | | | |
|---|---|---|---|
| 2,714,563 | 8/1955 | Poorman et al. | 428/937 |
| 2,972,550 | 2/1961 | Pelton | 427/191 |
| 3,071,489 | 1/1963 | Pelton et al. | 428/564 |
| 3,150,938 | 9/1964 | Pelton et al. | 428/564 |
| 3,378,392 | 4/1968 | Longo | 428/937 |
| 3,606,359 | 9/1971 | McCormick | 428/564 |
| 3,725,017 | 4/1973 | Prasse et al. | 428/937 |
| 4,136,230 | 1/1979 | Pabel | 428/937 |
| 4,162,392 | 7/1979 | Brown et al. | 428/628 |
| 4,173,685 | 11/1979 | Weatherly | 428/564 |
| 4,224,382 | 9/1980 | Brown et al. | 428/656 |
| 4,606,977 | 8/1986 | Dickson et al. | 428/553 |
| 4,699,848 | 10/1987 | Maybon | 428/564 |
| 4,715,486 | 12/1987 | Burgdorf et al. | 192/107 M |
| 4,731,253 | 3/1988 | DuBois | 427/34 |

OTHER PUBLICATIONS

"Tungsten Carbide Phase Transformation During the Plasma Spray Process", Chang, et al., J. Vac. Sci. Technol. A, vol. 3, No. 6 Nov./Dec. 1985, pp. 2479-2482.

"On the Influence of Thermophysical Data and Spraying Parameters on the Temperature Curve in Thermally Sprayed Coatings During Production", Knotek, et al., Surface and Coatings Technology, 36 (1988) pp. 99-110.

"On the Structure and Properties of Wear-and Corrosion-Resistant Nickel-Chromoim-Tungsten-Carbon-(-Silicon) Alloys," Knotek, et al., Thin Solid Films, 53 (1978) pp. 303-312.

"Friction and Wear Behaviour of Thermally Sprayed Nichrome-WC Coatings", Olivares et al., Surface and Coatings Technology, 33 (1987), pp. 183-190.

"Complex Carbide Powders for Plasma Spraying", Eschnauer et al., Thin Solid Films, 45 (1977) pp. 287-294.

"Carbide-Matrix Reactions in Wear Resistant Alloys", Knotek, et al., Institute for Werkstoffkunde B, University of Aachen, FRG pp. 281-297.

*Primary Examiner*—Shrive Beck
*Assistant Examiner*—Benjamin L. Utech
*Attorney, Agent, or Firm*—Cornelius F. O'Brien

[57] ABSTRACT

A tungsten chromium carbide-nickel coated article and process for producing it in which the coating contains chromium-rich particles having at least 3 times more chromium than tungsten and wherein said chromium-rich particles comprise at least about 4.5 volume percent of the coating.

7 Claims, No Drawings

METHOD OF PRODUCING TUNGSTEN CHROMIUM CARBIDE-NICKEL COATINGS HAVING PARTICLES CONTAINING THREE TIMES BY WEIGHT MORE CHROMIUM THAN TUNGSTEN

This application is a division of prior U.S. application: Ser. No. 07/441,712 filing date Nov. 27, 1989, now U.S. Pat. No. 4,999,255.

FIELD OF THE INVENTION

The invention relates to improved tungsten chromium carbide-nickel coatings for various substrates in which the coatings exhibit improved wear characteristics over conventional tungsten chromium carbide-nickel coatings and contain at least 4.5 volume percent of chromium-rich particles and wherein the chromium-rich particles contain at least 3 times more chromium than tungsten.

BACKGROUND OF THE INVENTION

Tungsten chromium carbide-nickel coatings are well known in the art for their wear resistance. They have properties similar to those of the more widely used tungsten carbide-cobalt coatings, but, because of the presence of chromium, have much better corrosion resistance. The use of nickel, rather than cobalt, may also be advantageous in some corrosive environments. These coatings are most frequently produced by thermal spraying. In this family of coating processes, the coating material, usually in the form of powder, is heated to near its melting point, accelerated to a high velocity, and impinged upon the surface to be coated. The particles strike the surface and flow laterally to form thin lenticular particles, frequently called splats, which randomly interleaf and overlap to form the coating. The family of thermal spray coatings includes detonation gun deposition, oxy-fuel flame spraying, high velocity oxy-fuel deposition, and plasma spray.

Flame plating by means of detonation using a detonating gun (D-Gun) has been used in industry to produce coatings of various compositions for over a quarter of a century. Basically, the detonation gun consists of a fluid-cooled barrel having a small inner diameter of about one inch. Generally a mixture of oxygen and acetylene is fed into the gun along with a comminuted coating material. The oxygen-acetylene fuel gas mixture is ignited to produce a detonation wave which travels down the barrel of the gun whereupon the coating material is heated and propelled out of the gun onto an article to be coated. U.S. Pat. No. 2,714,563 discloses a method and apparatus which utilizes detonation waves for flame coating. The disclosure of this U.S. Pat. No. 2,714,563 is incorporated herein by reference as if the disclosure was recited in full text in this specification.

In general, when the fuel gas mixture in a detonation gun is ignited, detonation waves are produced whereupon the comminuted coating material is accelerated to about 2400 ft/sec and heated to a temperature near its melting point. After the coating material exits the barrel of the detonation gun a pulse of nitrogen purges the barrel. This cycle is generally repeated about four to eight times a second. Control of the detonation coating is obtained principally by varying the detonation mixture of oxygen to acetylene.

In some applications it was found that improved coatings could be obtained by diluting the oxygen-acetylene fuel mixture with an inert gas such as nitrogen or argon. The gaseous diluent has been found to reduce or tend to reduce the flame temperature since it does not participate in the detonation reaction. U.S. Pat. No. 2,972,550 discloses the process of diluting the oxygen-acetylene fuel mixture to enable the detonation-plating process to be used with an increased number of coating compositions and also for new and more widely useful applications based on the coating obtainable. The disclosure of this U.S. Pat. No. 2,972,550 is incorporated herein by reference as if the disclosure was recited in full text in this specification.

Generally, acetylene has been used as the combustible fuel gas because it produces both temperatures and pressures greater than those obtainable from any other saturated or unsaturated hydrocarbon gas. However, for some coating applications, the temperature of combustion of an oxygen-acetylene mixture of about 1:1 atomic ratio of oxygen to carbon yields combustion temperatures much higher than desired. As stated above, the general procedure for compensating for the high temperature of combustion of the oxygen-acetylene fuel gas is to dilute the fuel gas mixture with an inert gas such as nitrogen or argon. Although this dilution lowers the combustion temperature, it also results in a concomitant decrease in the peak pressure of the combustion reaction. This decrease in peak pressure results in a decrease in the velocity of the coating material propelled from the barrel onto a substrate. It has been found that with an increase of a diluting inert gas to the oxygen-acetylene fuel mixture, the peak pressure of the combustion reaction decreases faster than does the combustion temperature.

In copending, commanly assigned application Ser. No. 110,841, filed Oct. 21, 1987, now abandoned, a novel fuel-oxidant mixture for use with an apparatus for flame plating using detonation means is disclosed. Specifically, this reference discloses that the fuel-oxidant mixture for use in detonation gun applications should comprise:

(a) an oxidant and (b) a fuel mixture of at least two combustible gases selected from the group of saturated and unsaturated hydrocarbons.

Ser. No. 110,841 also discloses an improvement in a process of flame plating with a detonation gun which comprises the step of introducing desired fuel and oxidant gases into the detonation gun to form a detonatable mixture, introducing a comminuted coating material into said detonatable mixture within the gun, and detonating the fuel-oxidant mixture to impinge the coating material onto an article to be coated and in which the improvement comprises using a detonatable fuel-oxidant mixture of an oxidant and a fuel mixture of at least two combustible gases selected from the group of saturated and unsaturated hydrocarbons. The detonation gun could consist of a mixing chamber and a barrel portion so that the detonatable fuel-oxidant mixture could be introduced into the mixing and ignition chamber while a comminuted coating material is introduced into the barrel. The ignition of the fuel-oxidant mixture would then produce detonation waves which travel down the barrel of the gun whereupon the comminuted coating material is heated and propelled onto a substrate. The oxidant disclosed is one selected from the group consisting of oxygen, nitrous oxide and mixtures thereof and the like and the combustible fuel mixture is at least two gases selected from the group consisting of acetylene ($C_2H_2$), propylene ($C_3H_6$), methane ($CH_4$), ethylene ($C_2H_4$), methyl acetylene ($C_3H_4$), propane ($C_3H_8$), ethane ($C_2H_6$), butadienes ($C_4H_6$), butylenes ($C_4H_8$), butanes ($C_4H_{10}$), cyclopropane ($C_3H_6$), propadiene ($C_3H_4$), cyclobutane ($C_4H_8$) and ethylene oxide ($C_2H_4O$). The preferred fuel mixture recited is acetylene gas along with at least one other combustible gas such as propylene.

Plasma coating torches are another means for producing coatings of various compositions on suitable substrates. Like the detonation gun process, the plasma coating technique is a line-of-sight process in which the coating powder is heated to near or above its melting point and accelerated by a plasma gas stream against a substrate to be coated. On impact the accelerated powder forms a coating consisting of many layers of overlapping thin lenticular particles or splats. This process is also suitable for producing tungsten chromium carbide-nickel based coatings.

Another method of producing the coatings of this invention may be the high velocity oxy-fuel, including the so-called hypersonic flame spray coating processes. In these processes, oxygen and a fuel gas are continuously combusted forming a high velocity gas stream into which powdered material of the coating composition is injected. The powder particles are heated to near their melting point, accelerated, and impinged upon the surface to be coated. Upon impact the powder particles flow outward forming overlapping thin, lenticular particles or splats.

U.S. Pat. No. 3,071,489 discloses a flame spraying process for producing a coating composition comprising about 70 weight percent of tungsten carbide, about 24 weight percent of chromium carbide, and about 6 weight percent of nickel.

Although tungsten chromium carbide-nickel based coatings can be obtained from the above processes, it is not apparent upon physically examining the coated articles how they will react when subjected to various hostile environments. It has been found that coated articles when subjected to wear and erosion tests can fail due to various reasons.

It is an object of the present invention to provide tungsten chromium carbide-nickel based coatings for various substrates such that the coated articles exhibit good wear and erosion resistance characteristics.

It is another object of the present invention to provide tungsten chromium carbide-nickel based coatings containing particles having a chromium-rich phase.

It is another object of the present invention to provide tungsten chromium carbide-nickel based coatings having a matrix with a substantial amount of amorphous phase.

It is another object of the present invention to provide a process for producing a tungsten chromium carbide-nickel based coating having chromium-rich particles and a matrix having a substantial amount of amorphous phase.

The foregoing and additional objects will become more apparent from the description and disclosure hereinafter.

SUMMARY OF THE INVENTION

The invention relates to a tungsten chromium carbide-nickel coated article comprising a substrate coated with a tungsten chromium carbide-nickel coating containing chromium-rich particles in which the amount of chromium in the particles is at least 3 times greater by weight than the amount of tungsten and wherein said chromium-rich particles comprise at least about 4.5 volume percent, preferably above 5 volume percent of the coating. Preferably, the amount of chromium in the chromium-rich particles should be from 3.5 to 20 times greater by weight than the amount of tungsten in the chromium-rich particles and most preferably from 3.5 to 10 times greater by weight than the amount of tungsten in the chromium-rich particles.

The chromium-rich particles of the coating of this invention have been observed using energy dispersive spectroscopic analysis (EDS) to contain 10 to 20 weight percent tungsten, 70 to 90 weight percent chromium and 0 to 5 weight percent nickel. It should be appreciated that using energy dispersive spectroscopic analysis (EDS) on a scanning electron microscope (SEM) does not allow determination of low atomic weight elements such as carbon. In addition to chromium-rich particles, the coating was found to also contain particles having at least 90 weight percent tungsten, 1 to 10 weight percent chromium and 0 to 2 weight percent nickel; particles having 70 to 80 weight percent tungsten, 15 to 25 weight percent chromium, and 0 to 5 weight percent nickel; and particles having 35 to 60 weight percent tungsten, 35 to 60 weight percent chromium and 0 to 10 weight percent nickel.

The tungsten chromium carbide-nickel coating of this invention also has a matrix with a large amount of amorphous phase. Specifically at least 25 percent by volume of the matrix and preferably at least 50 percent by volume of the matrix of the coating has an amorphous phase. The matrix component of this coating is the non-carbide constituents and at least 25% by volume of the matrix is amorphous.

The invention is also directed to a process for producing a tungsten chromium carbide-nickel coating on a substrate comprising the steps:

(a) preparing powders containing tungsten, chromium, carbon and nickel;

(b) heating the powders of step (a) to essentially melt the powders and impinging said powders while essentially in the molten state onto a substrate to be coated; and (c) quenching the molten powders on the substrate to produce a tungsten chromium carbide-nickel coating on said substrate.

Preferably, the process for producing a tungsten chromium carbide-nickel coating would comprise the steps:

(a) introducing desired fuel and oxidant gases into a detonation gun to form a detonatable mixture, introducing powders containing tungsten, chromium, carbon and nickel into said detonation gun to provide a mixture of said powders with said detonatable mixture;

(b) detonating the fuel-oxidant mixture to essentially melt the powders and impinge the particles while essentially in the molten state onto a substrate to be coated; and (c) quenching the molten powders on the substrate to produce a tungsten chromium carbide-nickel coating on said substrate.

Preferably, when using the detonatable process, the detonatable fuel-oxidant mixture should comprise an oxidant and a fuel mixture of at least two combustible gases selected from the group of saturated and unsaturated hydrocarbons such as a mixture of acetylene and propylene.

The process of this invention, whether or not it be by thermal spraying techniques such as a detonation gun technique, should be repeated until the desired thickness of the coating is obtained. Unlike prior processes for depositing tungsten chromium carbide-nickel coatings, the inventive process propels the molten powders at a higher velocity and sufficiently high temperature so that the powders are essentially in the molten state but not significantly superheated when they contact the substrate. The particles, as a result of their very high velocity on impact, flow laterally into unusually thin splats. As a result of the low superheat and thin splat structure, the quench rate (cooling rate) of the splats is extremely high. It is believed that the depositing of the powders while essentially in the molten state onto the substrate combined with a high quench rate causes the higher volume of chromium-rich particles in the coating. It is also believed, although not wanting to be bound by theory, that the higher volume of chromium-rich particles contributes to the enhanced wear resistance characteristics of the coating. In addition, it is believed that the depositing of the particles while essentially in the molten state onto the substrate combined with a high quench rate produces a matrix for the coating that is at least 25 percent by volume in the amorphous phase, preferably at least 50 percent by volume in the amorphous phase. The large amount of amorphous phase in the matrix in the coating is also believed to provide superior wear resistance characteristics of the coating.

As disclosed in U.S. application Ser. No. 110,841, acetylene is considered to be the best combustible fuel for detonation gun operations since it produces both temperatures and pressures greater than those obtainable from any other saturated or unsaturated hydrocarbon. To reduce the temperature of the reaction products of the combustible gas, nitrogen or argon was generally added to dilute the oxidant-fuel mixture. This had the disadvantage of lowering the pressure of the detonation wave thus limiting the achievable particle velocity. However, when a second combustible gas, such as propylene, is mixed with acetylene, the reaction of the combustible gases with an appropriate oxidant yields a peak pressure at any temperature that is higher than the pressure of an equivalent temperature nitrogen diluted acetylene-oxygen mixture. If, at a given temperature, an acetylene-oxygen-nitrogen mixture is replaced by an acetylene-second combustible gas-oxygen mixture, the gaseous mixture containing the second combustible gas will always yield higher peak pressure than the acetylene-oxygen-nitrogen mixture. It is this higher pressure that increases particle velocity while at the same time having a temperature high enough to insure that the particles are propelled against the substrate while still essentially in the molten state, but not significantly superheated.

The gaseous fuel-oxidant mixture when using detonation gun techniques could have a ratio of atomic oxygen to carbon of from about 0.9 to about 1.2 and preferably from about 0.95 to 1.1.

The tungsten chromium carbide-nickel based coating should comprise from about 55 to about 80 weight percent tungsten, from about 12 to about 26 weight percent chromium, from about 3 to about 9 weight percent carbon and from about 3 to about 10 weight percent nickel. Preferably the tungsten should be from about 60 to about 75 weight percent, the chromium from about 16 to about 23 weight percent, the carbon from 4 to 8 weight percent, nickel from about 4 to about 9 weight percent. The tungsten chromium carbide-nickel coatings of this invention are ideally suited for coating substrates made of materials such as titanium, steel, aluminum, nickel, iron, copper, cobalt, alloys thereof and the like.

The powders of the coating material for use in obtaining the coated layer of this invention are preferably powders made by the sintered and crushed process. In this process, the constituents of the powders are sintered at high temperature and the resultant sinter product is crushed and sized.

EXAMPLE 1

The gaseous fuel-oxidant mixture of the composition shown as Sample Process A and Sample Process B of Table 1 were introduced to a detonation gun to form a detonatable mixture. Powder having the composition of about 67 weight percent tungsten, about 22 weight percent chromium, about 6 weight percent carbon and about 5 weight percent nickel was also fed into the detonation gun. The flow rate of each gaseous fuel-oxidant mixture was 11 to 13 cubic feet per minute (cfm) and the feed rate of each coating powder was 140 grams per minute (gpm). The gaseous fuel-mixture in volume percent and the atomic ratio of oxygen to carbon for each coating process is shown in Table 1. The coating sample powder was fed into the detonating gun at the same time as the gaseous fuel-oxidant mixture. The detonation gun was fired at a rate of about 8 times per second and the coating powder in the detonation gun was impinged onto a steel substrate while in the molten state to form a dense, adherent coating of shaped microscopic leaves interlocking and overlapping with each other.

The coating produced using the Sample Process A is referred to as Sample Coating A and the coating produced using the Sample Process B is referred to as Sample Coating B. The Sample Coating A was found to have a matrix with an amorphous phase of at least 25 percent by volume while the Sample Coating B was found to have a matrix with an amorphous phase of less than 15 percent by volume as determined by using transmission electron microscopic analysis.

TABLE 1

Nominal D-Gun Parameters for Applying the Coating

| Sample Process | Powder Feed Rate (gpm) | Flow Rate $ft^3$/min | Gaseous Fuel-Mixture % $N_2$ | $C_2H_2$ | $O_2$ | $C_3H_6$ | O to C Atomic Ratio |
|---|---|---|---|---|---|---|---|
| A | 140 | 13 | | 8 | 60 | 32 | 1.05 |
| B | 140 | 11 | 35 | 32.5 | 32.5 | 0 | 1.00 |

Hardness Tests

The hardnesses of the coatings were measured using a Rockwell superficial hardness tester and a Vickers hardness tester. The Rockwell hardness was measured on the surface of the coating by ASTM Standard Method E-18. Superficial hardness scale 45N was used. The Vickers hardness was measured on cross section of the coatings. $HV_{0.3}$ designates the Vickers hardness using a 0.3 kg load.

Sand Abrasion Test

To test the coatings for resistance to scratching abrasion, ASTM recommended practice G-65 was followed. In this test, the coating is abraded by a grit which is pressed against the coating by a rotating rubber wheel.

Specifically, a 50–70 mesh silica sand was used for the grit. The rubber wheel was made of chlorobutyl rubber with a durometer hardness A58–60. Wheel speed was 200 rpm. The wheel was forced against the coating surface with a 30 lb. load for 6000 revolutions. Wear was measured by the loss of coating material per 1000 revolutions.

Erosion Test

Erosion resistance of the coating was tested by following ASTM recommended practice G-76. In this test, solid particles (27μ alumina) are entrained in a gas (argon) jet and impinge against the coating surface usually at angles of 30° or 90° to the horizontal. Erosion is measured by loss of coating per unit of particles.

The average hardness, sand abrasion and erosion data are shown in Table 2 for several coatings of Sample Coating A and Sample Coating B produced by Sample Process A and Sample Process B, respectively.

TABLE 2

| Sample Coating | Hardness Vickers ($kg/mm^2$) | Hardness Rockwell (45N) | Sand Abrasion ($mm^3$/1000 rev.) | Erosion (μm/gm) 90° | Erosion (μm/gm) 30° |
|---|---|---|---|---|---|
| A | 998 | 75 | 1.0 | 100 | 22 |
| B | 1042 | 72 | 1.4 | 175 | 27 |

Constituent Volume Test

ASTM recommended practice E-562 was used to determine the volume fraction of large chromium-rich particles (approximate metallic content by energy dispersive spectroscopy: 10–20W, 70–90Cr, 0–5Ni) present in both Sample Coating A and Sample Coating B. These particles are one of the most distinguishing features present in both microstructures.

E-562 describes a manual point counting method which statistically estimates the volume fraction of a distinguishable microstructural constituent which in this case was the volume fraction of the chromium-rich particles.

The data obtained using the E-562 test procedure for several samples of each type of coating are given in Table 3.

TABLE 3

| Sample Coating | Volume Fraction of Chromium-Rich Particles: Average Vol. % | High Vol. % | Low Vol. % |
|---|---|---|---|
| A | 7.7 | 13 | 5.5 |
| B | 3.1 | 4.3 | 1.8 |

This data shows that the coating with the higher volume of chromium-rich particles (Sample Coating A) had better abrasion and erosion resistance characteristics than the coating with the lower volume of chromium-rich particles (Sample Coating B) as can be seen from the data presented in Table 2.

Wear Loss Test

ASTM G-77 procedure was used to determine the wear loss of the coating. Wear losses were determined by measuring the loss of block or ring material in grams, the width of scar or crevices in the surface measured in inches and the percent of pullout or pits in the surface as determined by using the procedure of ASTM E-562. Specifically, coated rings were pressed against 2024 aluminum blocks with a force of 90 lb. load. The rings were rotated at 180 rpm for 5400 revolutions. A lubricant of 9% Tandemol R-91 (trademark for a lubricant made by E. F. Houghton and Company) in water was fed between the ring and the block. The data obtained are shown in Table 4.

TABLE 4

| Sample Coating | Block Scar Width (in) | Ring wt. loss (g) | Ring Surface % Pullout |
|---|---|---|---|
| A | .1599 | $1 \times 10^{-4}$ | 2.5 |
| B | .1497 | $2 \times 10^{-4}$ | 9.1 |

The results of the ASTM G-77 test demonstrate that the coating with the larger volume percent of chromium-rich particles had less weight loss, and fewer pits (percent pullouts) than the coating with the lesser volume percent of chromium-rich particles. Thus the chromium-rich particle coating of this invention has much better adhesive wear resistance.

Strain-to-Fracture Test

The strain-to-fracture of the coatings in the example was determined using a four point bend test. Specifically, a beam of rectangular cross-section made of 4130 steel hardened to 40–45 HRC is coated with the material to be tested. The typical substrate dimensions are 0.50 inch wide, 0.15 inch thick and 10 inches long. The coating area is 0.50 inch by 6 inches, and is centered along the 10 inch length of the substrate. The coating thickness is typically 0.015 inch, although the applicability of the test is not affected by the coating thickness in the range between 0.010 to 0.020 inch. An acoustic transducer is attached to the sample using a couplant high vacuum grease, and masking tape. The acoustic transducer is piezoelectric, and has a frequency response band width of 90–640 kHz. The transducer is attached to a preamplifier with a fixed gain of 40 dB. The amplifier is attached to a counter which counts the number of times the signal exceeds a threshold value of 1 millivolt, and outputs a voltage proportional to the total counts. In addition, a signal proportional to the peak amplitude of an event is also recorded.

The coated beam is placed in a four point bending fixture with the coating in tension. The bending fixture is designed to load the beam in four point bending. The outer loading points are 8 inches apart on one side of the beam, while the middle points of loading are 2¾ inches of the coated beam in a uniform stress state. A universal test machine is used to displace the two sets of loading points relative to each other, resulting in bending of the test sample at the center. The sample is bent so that the coating is on the convex side of the bar; i.e., the coating is placed in tension. During bending the deformation of the sample is monitored by either a load cell attached to the universal test machine or a strain gage attached to the sample. If the load is measured, engineering beam theory is used to calculate the strain in the coating. During bending, the acoustic counts and peak amplitude are also recorded. The data are simultaneously collected with a three pen chart recorder and a computer. When cracking of the coating occurs, it is accompanied by acoustic emission. The signature of acoustic emission associated with through-thickness cracking includes about $10^4$ counts per event and a peak amplitude of 100 dB relative to 1 millivolt at the transducer.

The strain present when cracking begins is recorded as the strain-to-fracture of the coating.

The strain-to-fracture of the optimum coating with the larger volume percent chromium-rich particles was 0.35% while the strain-to-fracture of the coating with the smaller amount of chromium-rich particles was 0.25%.

The data above clearly shows that a tungsten chromium carbide-nickel coating having chromium-rich particles of at least 4.5 volume percent and a matrix with an amorphous phase of at least 25 percent by volume had fewer pits and therefore greater retention of a smooth surface; superior adhesive wear characteristics; superior sand abrasion characteristics; superior erosion resistance at 90°; and superior strain-to-fracture characteristics than a tungsten chromium carbide-nickel coating having a volume percent of chromium-rich particles of less than 4.5 percent and a matrix with an amorphous phase of less than 25 percent by volume.

EXAMPLE 2

Coated articles were produced as in Example 1 and then the microstructures were examined using an energy dispersive spectroscopic analyzer on a scanning electron microscope. Many similar appearing particles were analyzed and the results were combined to establish the range of composition of four identifiable types of particles as shown in Table 5.

TABLE 5

| Particles | percent by weight | | |
|---|---|---|---|
| | W | Cr | Ni |
| A | 90+ | 1-10 | 0-2 |
| B | 70-80 | 15-25 | 0-5 |
| C | 35-60 | 35-60 | 0-10 |
| D | 10-20 | 70-90 | 0-5 |

These identifications are not meant to rule out the possibility of additional types of particles, but the shape and shading of these four types of particles were most consistent throughout the many areas viewed. Energy dispersive spectroscopic analysis does not allow determination of low atomic weight elements such as carbon. As shown in Table 5, Particles D contain from 3.5 to 9.0 times more chromium than tungsten.

EXAMPLE 3

Coated articles were produced as in Example 1 and the roughness of the as-coated surface was measured. Sample Coating A produced by Sample Process A has a surface roughness range of 150 to 200 microinches Ra while Sample Coating B produced by Sample Process B had a surface roughness range of 300 to 350 microinches Ra. Thus the coating with the higher volume percent of chromium-rich particles was about 50% smoother than Sample Coating B. In addition, Sample Coating A was free of nodules present on Sample Coating B. Further, after finishing the coatings by grinding, Sample Coating A showed fewer pits or pullouts than Sample Coating B.

The tungsten chromium carbide-nickel coating of this invention is ideally suited for use on such substrates as turbine blades, metal working and processing rolls, processing and calender rolls for paper, magnetic tape and plastic film; mechanical seals, valves and the like. When the article is a roll, the substrate is generally made of steel and has a tungsten chromium carbide-nickel coating from 1 to 20 mils thick, preferably from 2 to 10 mils thick.

While the examples above use detonation gun means to apply the coatings, coatings of this invention may be produced using other thermal spray technologies, including, but not limited to, plasma spray, high velocity oxy-fuel deposition, and hypersonic flame spray.

As many possible embodiments may be made of this invention without departing from the scope thereof, it being understood that all matter set forth is to be interpreted as illustrative and not in a limiting sense.

What is claimed:

1. A process for producing a tungsten chromium carbide-nickel coating on a substrate comprising the steps:

(a) preparing powders containing tungsten, chromium, carbon and nickel;

(b) heating the powders of step (a) to essentially melt the powders and impinging said powders while essentially in the molten state onto a substrate to be coated; and (c) quenching the molten powders on the substrate to produce a tungsten chromium carbide-nickel coating on said substrate having chromium-rich particles in which the chromium in said particles is at least 3 times greater by weight than the tungsten in said particles, wherein said particles comprise at least about 4.5 volume percent of the coating and wherein the non-carbide matrix of the coating is at least 25 percent by volume amorphous.

2. The process of claim 1, using a detonation gun and wherein step (a) comprises introducing desired fuel and oxidant gases into a detonation gun to form a detonatable mixture, introducing the powder containing tungsten, chromium, carbon and nickel into said detonation gun to provide a mixture of said powders with said detonatable mixture and wherein step (b) comprises detonating the fuel-oxidant mixture to impinge said powders onto the substrate while said powders are essentially in the molten state.

3. The process of claim 1, or 2 wherein the steps (a), (b), and (c) are repeated at least twice to produce a desired thickness of the coating on the substrate.

4. The process of claim 2 wherein the detonatable fuel-oxidant mixture comprises an oxidant and a fuel mixture of at least two combustible gases selected from the group of saturated and unsaturated hydrocarbons.

5. The process of claim 4 wherein the fuel mixture comprises acetylene and proplyene.

6. The process of claim 1 or 2 wherein the powders in step (a) contain from about 55 to 80 weight percent tungsten, from about 12 to 26 weight percent chromium, from about 3 to 9 weight percent carbon and from about 3 to 10 weight percent nickel.

7. The process of claim 6 wherein in step (c) the chromium-rich particles contain at least 3.5 to 20 times more chromium than tungsten and wherein said chromium-rich particles comprise at least 5 volume percent of the coating.

* * * * *